US009590363B2

(12) United States Patent
Wu et al.

(10) Patent No.: US 9,590,363 B2
(45) Date of Patent: Mar. 7, 2017

(54) CABLE CONNECTOR ASSEMBLY WITH AN IMPROVED CABLE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 52 days.

(21) Appl. No.: 14/852,638

(22) Filed: Sep. 14, 2015

(65) Prior Publication Data

US 2016/0079714 A1 Mar. 17, 2016

(30) Foreign Application Priority Data

Sep. 12, 2014 (CN) ..... 2014 1 0462063

(51) Int. Cl.
*H01B 9/00* (2006.01)
*H01R 13/6585* (2011.01)
(Continued)

(52) U.S. Cl.
CPC ..... *H01R 13/6585* (2013.01); *H01B 9/003* (2013.01); *H01B 9/006* (2013.01);
(Continued)

(58) Field of Classification Search
CPC ... H01B 7/00; H01B 7/02; H01B 7/03; H01B 9/00; H01B 9/003; H01B 9/006; H01B 9/02; H01B 11/00; H01B 11/06
(Continued)

(56) References Cited

U.S. PATENT DOCUMENTS 6,674,010 B2 * 1/2004 Inui ..... H01B 11/06 174/113 C
7,304,241 B2 * 12/2007 Trieb ..... H01R 9/032 174/74 R
(Continued)

OTHER PUBLICATIONS

Universal Serial Bus Type-C Cable and Connector Specification,Revision 1.0 RC2,Aug. 2014,3.3 Cable Construction and Wire Assignments,pp. 50-54.

*Primary Examiner* — William H Mayo, III
(74) *Attorney, Agent, or Firm* — Wei Te Chung; Ming Chieh Chang

(57) ABSTRACT

A cable connector assembly includes an electrical connector (100) and cable (300) connected with the electrical connector. The cable has a plurality of core wires (31) including a plurality of first wires (34) and second wires (35), an outer jacket (32) enclosing on the core wires, and a shielding layer (33) enclosing the second wires. The first wires having a power wire (341) for power transmission and a plurality of coaxial wires (342) for high speed signal transmission, wherein the second wires have a detective wire (351) for detection signal transmission, a pair of ground-wires (352), a twisted pair wire (353) for USB 2.0 signal transmission an spare wire (354). Each of the first wires has a larger diameter than that of second wires, and the first wires are located between the shielding layer and outer jacket, the second wires are enclosed in the shielding layer.

17 Claims, 11 Drawing Sheets

(51) Int. Cl.
*H01R 13/66* (2006.01)
*H01B 11/00* (2006.01)
*H01B 11/06* (2006.01)

(52) U.S. Cl.
CPC ..... *H01B 11/002* (2013.01); *H01B 11/06* (2013.01); *H01R 13/665* (2013.01)

(58) Field of Classification Search
USPC ..... 174/102 R, 108, 106 R, 110 R, 113 R, 174/113 C
See application file for complete search history.

(56) References Cited

U.S. PATENT DOCUMENTS 7,918,685 B1 * 4/2011 Kruckenberg ..... H01B 11/00 174/75 C
8,039,749 B2 * 10/2011 Okano ..... H01B 11/1008 174/113 R
8,076,580 B2 * 12/2011 Kolasa ..... H01B 11/00 174/105 R
8,133,071 B2 3/2012 Huang et al.
8,546,690 B2 * 10/2013 Masakazu ..... H01B 11/002 174/103
2003/0121694 A1 * 7/2003 Grogl ..... H01B 3/441 174/113 R
2005/0061536 A1 * 3/2005 Proulx ..... G06Q 10/08 174/102 R
2008/0314613 A1 * 12/2008 Huang ..... H01B 7/04 174/107
2009/0260849 A1 * 10/2009 Cardas ..... H01B 11/12 174/114 R
2010/0051318 A1 * 3/2010 Wang ..... H01B 11/12 174/113 R
2010/0084157 A1 * 4/2010 Wang ..... H01B 11/12 174/107
2016/0225488 A1 * 8/2016 Pon ..... H01B 9/003

* cited by examiner

CABLE CONNECTOR ASSEMBLY WITH AN IMPROVED CABLE

BACKGROUND OF THE INVENTION

1. Field of the Invention

The present invention relates to a cable connector assembly, and more particularly to a structure of core wires thereof.

2. Description of Related Art

U.S. Pat. No. 8,133,071, issued on Mar. 13, 2012, shows a cable connector assembly including a flat cable and a flexible printed circuit. The cable defines a row of core wires and an insulative layer enclosing the core wires. The core wires comprise a plurality of coaxial cables and a plurality of single wires. The flexible printed circuit comprises a plurality of pads arranged in a line and a lengthwise grounding portion separated from the pads. Each coaxial cable comprises an inner conductor connected to a corresponding pad and an outer conductor connected to the grounding portion. The single wires comprise a plurality of power wires connected to corresponding pads and a plurality of grounding wires connected to the grounding portion. The coaxial cables and the single wires are arranged in one row. When soldering the coaxial wires, outer insulative layers of adjacent single wires might be damaged.

An improved cable connector assembly is desired to offer advantages over the related art.

BRIEF SUMMARY OF THE INVENTION

Accordingly, an object of the present invention is to provide a cable connector assembly with good electrically connection.

In order to achieve the above-mentioned object, a cable connector assembly in accordance with the present invention comprises: an electrical connector and a cable connected with the electrical connector. The cable comprises a plurality of core wires including a plurality of first wires and a plurality of second wires, an outer jacket enclosing on the core wires, and a shielding layer enclosing on the second wires. The first wires comprises a power wire for power transmission and a plurality of coaxial wires for high speed signal transmission, the second wires comprises a detective wire for detection signal transmission, a pair of grounding wires, a twisted pair wire for USB 2.0 signal transmission and a spare wire, each of the first wires has a larger diameter than that of the second wires, the first wires are located between the shielding layer and the outer jacket, the second wires are enclosed in the shielding layer.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
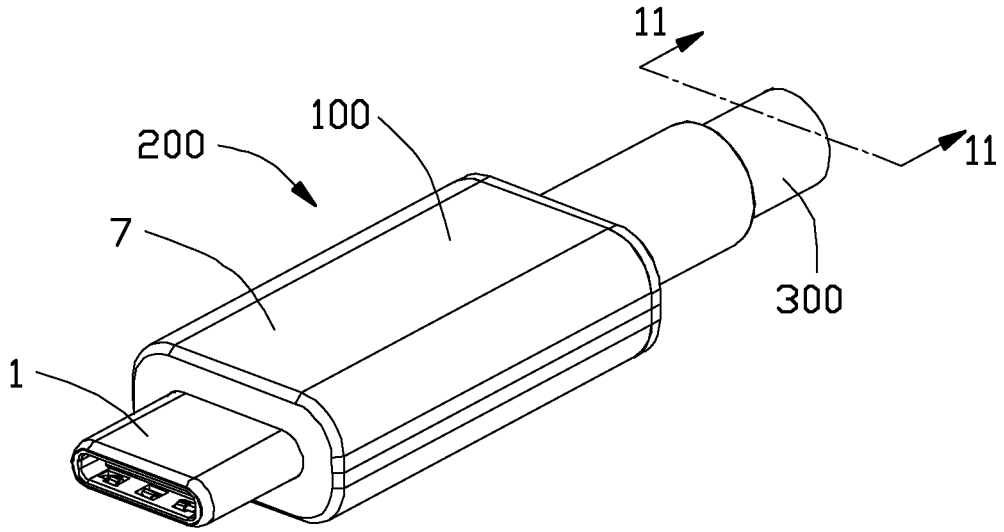
FIG. 1 is a perspective view of a cable connector assembly according to the present invention.
Figure 2:
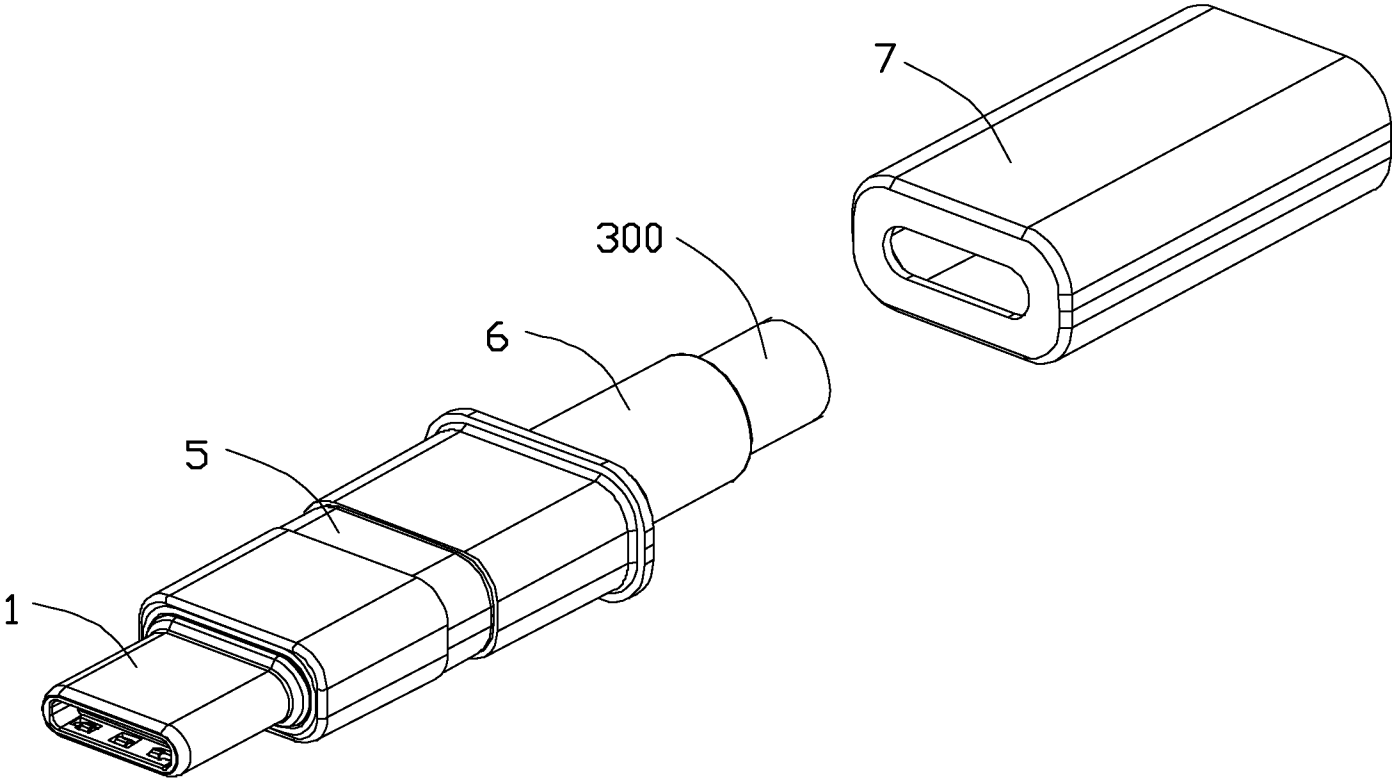
FIG. 2 is an exploded view of the cable connector assembly shown in FIG. 1.

Referring to FIGS. 1-7, a cable connector assembly 200 in accordance with the present invention can be mated with a complementary connector. The cable connector assembly 200 comprises an electrical connector 100 and a cable 300 connecting with the electrical connector 100. The electrical connector 100 comprises a sub-connector 1, a printed circuit board (PCB) 2 electrically connected with the sub-connector 1, a cable 300 electrically connected with the printed circuit board 2, a retaining member 4 limiting the cable 300, an inner insulator 5 enclosing on the sub-connector 1 and the cable 300, a strain relief member 6 formed on the inner insulator 5 and the cable 300, and an outer cover 7. The cable connector assembly 200 is capable of mating with the complementary connector along a forward direction and a reverse direction to achieve the same function.

Figure 9:
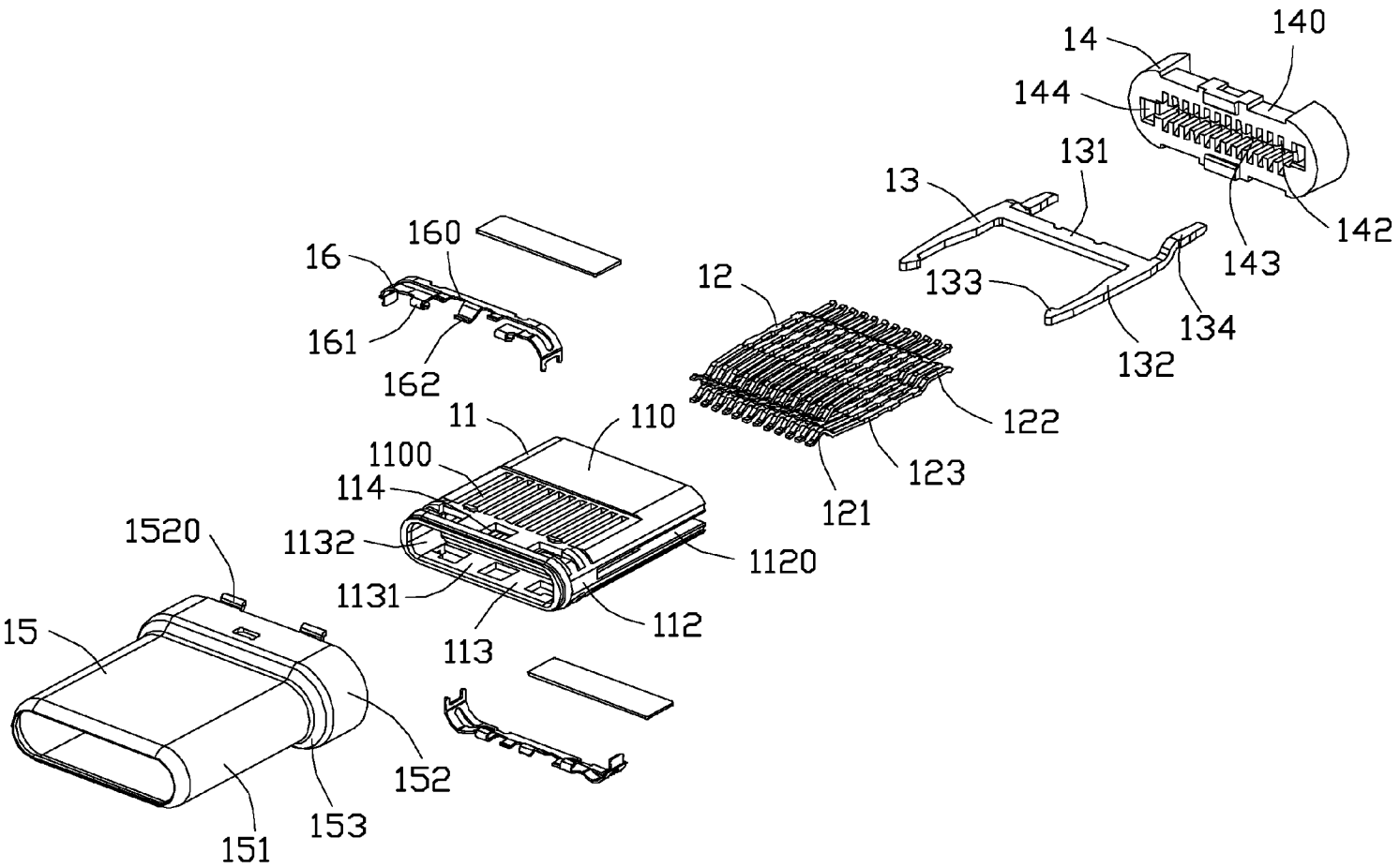
FIG. 9 is a perspective view of a sub-connector of the cable connector assembly shown in FIG. 6.
Figure 10:
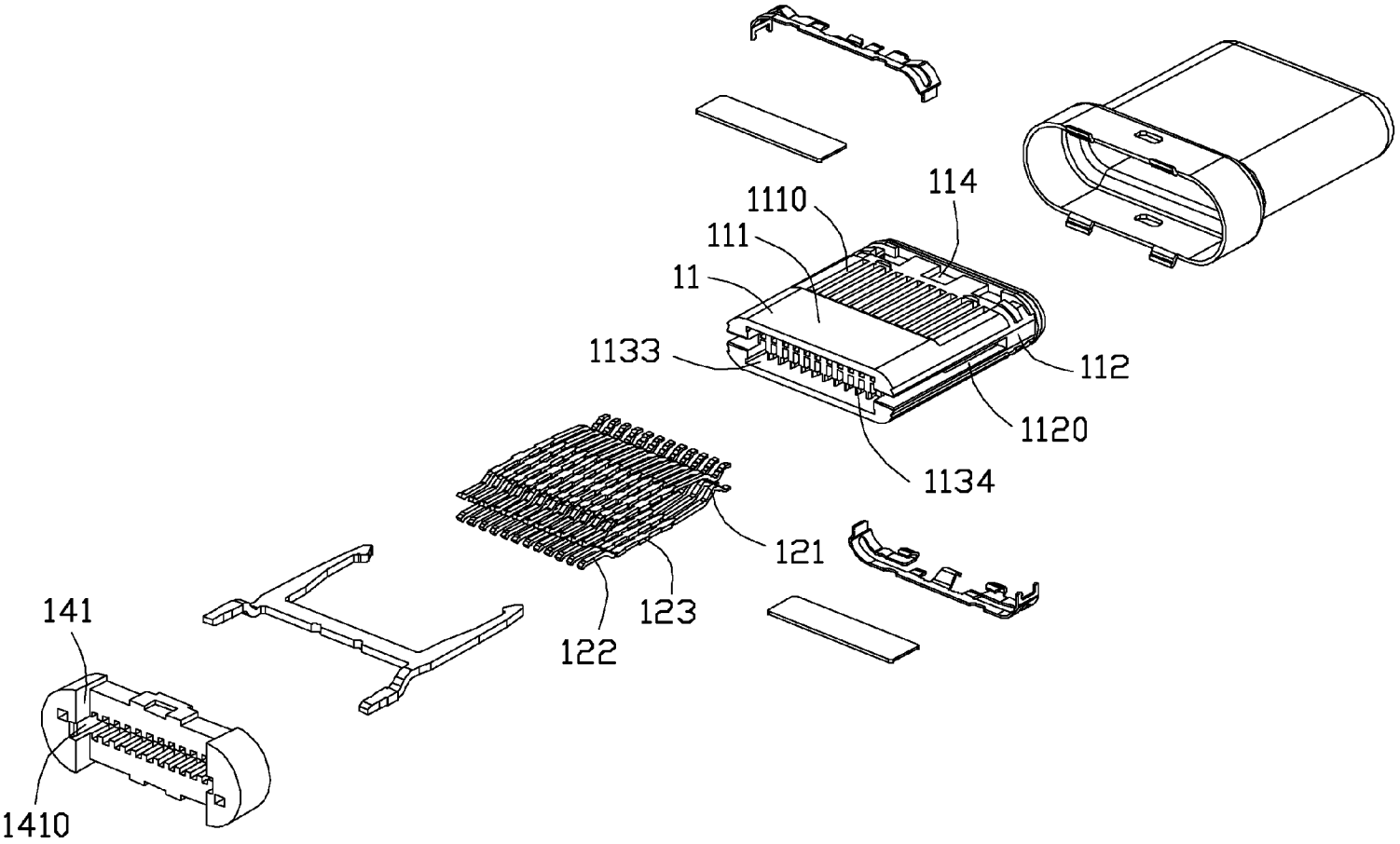
FIG. 10 is a view similar to FIG. 9, but viewed from another aspect.

Referring to FIGS. 9-10, the sub-connector 1 comprises an insulative housing 11, a plurality of contacts 12 retained in the insulative housing 11 and divided in two rows spaced apart from each other along an up-to-down direction, a latch member 13 defined between the two rows of contacts 12 and engaging with the complementary connector, an insulative member 14 disposed behind the insulative housing 11, a metal shell 15 disposed outside of the insulative housing 11 and the insulative member 14, and a pair of grounding members 16 disposed on the insulative housing 11 and electrically connected to the metal shell 15. It is noted that in this embodiment the two rows of contacts 12 refer to the mating configuration defined by Type C of the USB (Universal Serial Bus) connector wherein the two rows of contacts are arranged in a diagonally symmetrical manner, i.e., a flippable mating manner.

The insulative housing 11 has a top wall 110, a bottom wall 111 parallel with the top wall 110, and a pair of side walls 112 spaced apart from and parallel with each other, the two side walls 112 linking with the top wall 110 and the bottom wall 111. A receiving space 113 is formed by the top wall 110, the bottom wall 111, and the pair of side walls 112. The receiving space 113 is divided into a front segment 1132 having a front opening 1131 and a rear segment 1134 having a rear opening 1133. The top wall 110 defines a plurality of top recesses 1100 in communication with the front segment 1132. The bottom wall 111 defines a plurality of bottom recesses 1110 in communication with the front segment 1132. Each of the side walls 112 defines a side recess 1120 extending forwardly from a rear end of the insulative housing 11 but not through a front end of the insulative housing 11. The side recesses 1120 are in communication with the front segment 1132 and the rear segment 1134 of the receiving space 113. A plurality of recessing holes 114 are formed on a front end of the top wall 110 and the bottom wall 111.

Each of the contacts 12 comprises a front mating portion 121 extending forwardly into the front segment 1132 of the receiving space 113, a rear mating portion 122 extending rearwardly, and an intermediate mounting portion 123 secured to the insulative housing 11. The front mating portion 121 is mating with the complementary connector and the rear mating portion 122 is mating with the PCB 2. The front mating portions 121 of the two rows of contacts 12 are arranged face to face along the up-to-down direction.

The latch member 13 comprises a base portion 131 extending along a transverse direction, a pair of latch arms 132 respectively extending forwardly from two opposite ends of the base portion 131, a latch portion 133 extending from a front end of each latch arm 132 along a face to face direction, and a pair of extending arms 134 extending opposite to the corresponding latch arm 132 from two ends of the base portion 131. One extending arm 134 is higher than the plane of the base portion 131, and another extending arm 134 is lower than the plane of the base portion 131. The latch member 13 is mounted into the insulative housing 11 through the rear opening 1133 of the rear segment 1134 of the receiving space 113. The latch arms 132 are received into the corresponding side recesses 1120, respectively. At least a portion of each latch portion 133 projects into the front segment 1132 of the receiving space 113. The pair of latch portions 133 are arranged face to face along the transverse direction.

The insulative member 14 cooperates with the insulative housing 11 to fix the latch member 13. The insulative member 14 comprises an insulative base portion 140, a pair of extending portions 141 respectively extending rearwardly from two opposite ends of the insulative base portion 140, two rows of through holes 142 spaced apart in the up-to-down direction and extending through the insulative base portion 140 along a front-to-rear direction, a receiving slot 143 disposed between two rows of the through holes 142 and communicated with the through holes 142, and a pair of receiving holes 144 disposed on two sides of the receiving slot 143. The extending portion 141 comprises a mounting slot 1410 extending along a front-to-rear direction. When the insulative member 14 is mounted to the insulative housing 11 along a rear-to-front direction, the contacts 12 are inserted into two rows of the through holes 142, the base portion 131 is received in the receiving slot 143, and the pair of extending arms 134 extend into the corresponding receiving hole 144.

The metal shell 15 has a closed circumference with a good seal performance and a good anti-EMI performance, etc. The closed circumference of the metal shell 15 could be manufactured by drawing a metal piece, bending a metal piece, die casting, etc. The metal shell 15 comprises a first front end 151 for being inserted into the mating connector, a first rear end 152, and a first transition portion 153 for connecting the first front end 151 and the first rear end 152. The first rear end 152 is in the shape of the insulative member 14. A diametrical dimension of the first front end 151 is smaller than the diametrical dimension of the first rear end 152. The first rear end 152 comprises a pair of latch tabs 1520 projecting outwardly.

One of the grounding members 16 is received on the top recess 1110, and the other one is received on the bottom recess 1110. Each of the grounding members 16 comprises a flat body portion 160, a pair of spring tabs 161 extending and bending from the flat body portion 160 toward the insulative housing 11, and a grounding tab 162 extending forwardly from a front side of the flat body portion 160 and entering into the front segment 1132 of the receiving space 113. The spring tabs 161 and the grounding tab 162 are received in the recessing holes 114. The grounding tabs 162 are disposed face to face along the vertical direction and used for mating with the mating connector. A distance along the vertical direction between the grounding tabs 162 of the pair of grounding members 16 is greater than a distance along the vertical direction of the front mating portions 121 of the two rows of contacts 12.

Figure 6:
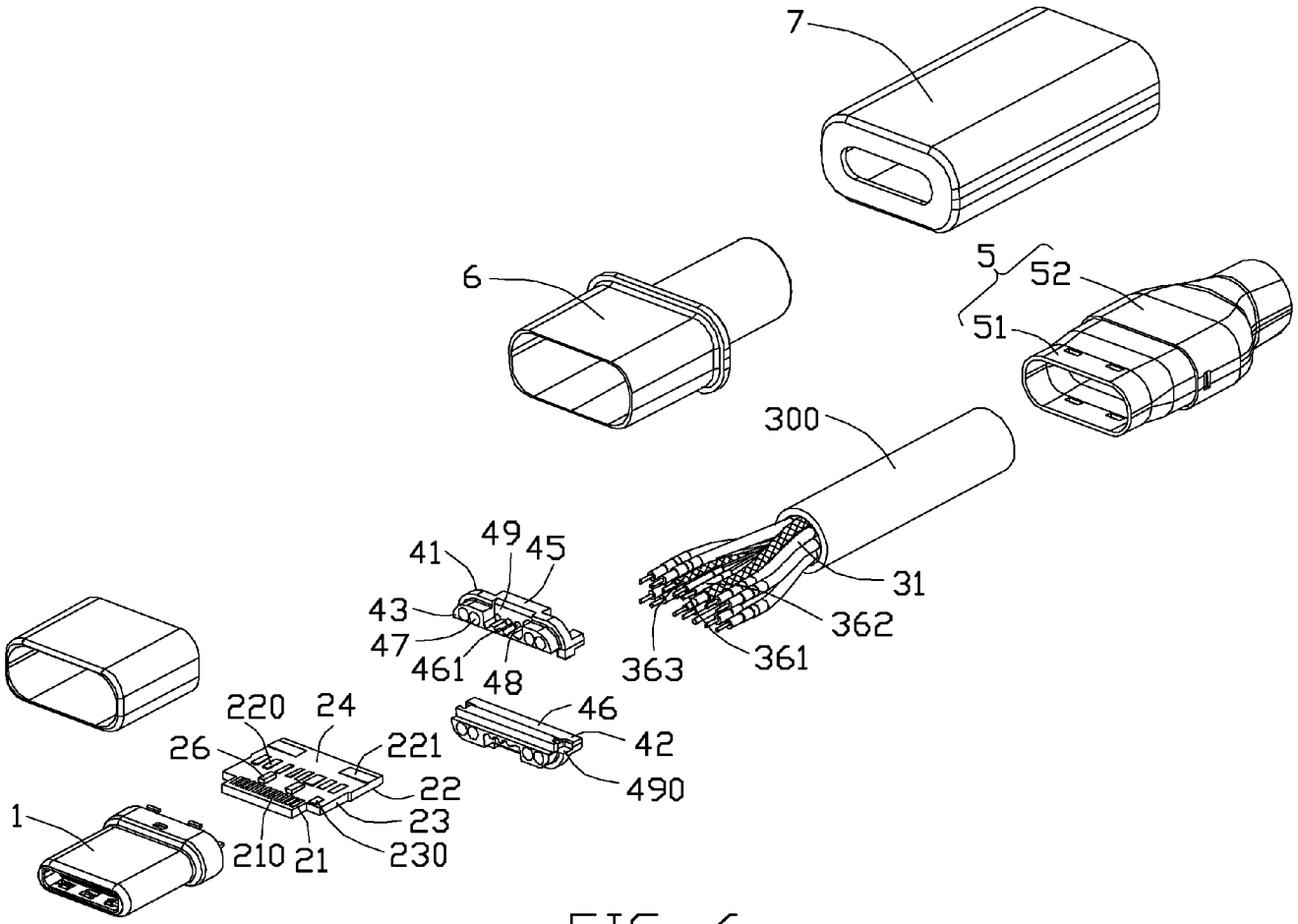
FIG. 6 is a further exploded view of the cable connector assembly shown in FIG. 4.
Figure 7:
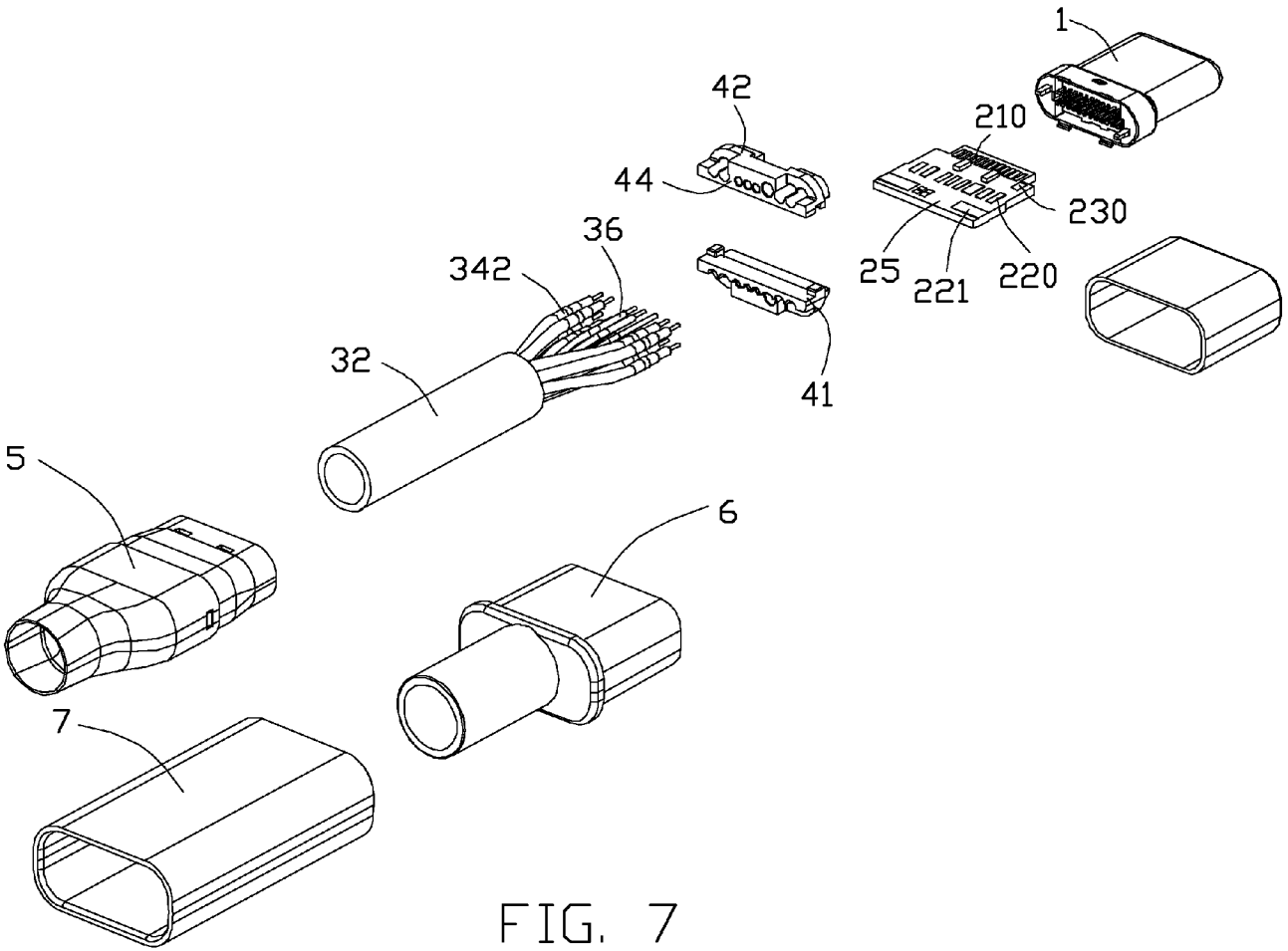
FIG. 7 is a view similar to FIG. 6, but viewed from another aspect.

Referring to FIGS. 6-7, the PCB 2 is disposed between the sub-connector 1 and the cable 300. The cable 300 is electrically connected with the contacts 12 by the PCB 2. The PCB 2 comprises a front end portion 21, a rear end portion 22, and a middle portion 23 connecting the front end portion 21 and the rear end portion 22. The PCB 2 comprises an upper surface 24 and an opposite lower surface 25. The upper and the lower surfaces 24, 25 of the front end portion 21 comprise a plurality of first conductive pads 210 connected with the rear mating portion 122 of the contacts 12, while the upper and the lower surfaces 24, 25 of the rear end portion 22 comprise a plurality of second conductive pads 220 connected to the cable 300. A plurality of third conductive pads 221 are disposed behind the second conductive pads 220. A size of the front end portion 21 of the PCB 2 is smaller than the size of the rear end portion 22 along a transverse direction. A pitch between the adjacent first conductive pads 210 is smaller than the pitch between the adjacent second conductive pads 220. The size of the second conductive pad 220 is larger than the size of the first conductive pad 210, and the number of the first conductive pads 210 is greater than the number of the second conductive pads 220. The middle portion 23 of each of the upper and the lower surfaces comprises a metal pad 230 for soldering with the extending arm 134 of the latch member 13 to fasten the latch member 13.

The front portion 21 of the PCB 2 is mounted in the mounting slot 1410 and between the rear mating portions 122 of the two rows of contacts 12. The rear mating portions 122 of the contacts 12 are electrically connected with the corresponding first conductive pads 210. A number of electronic elements 26 are disposed on the PBC 2.

Figure 8:
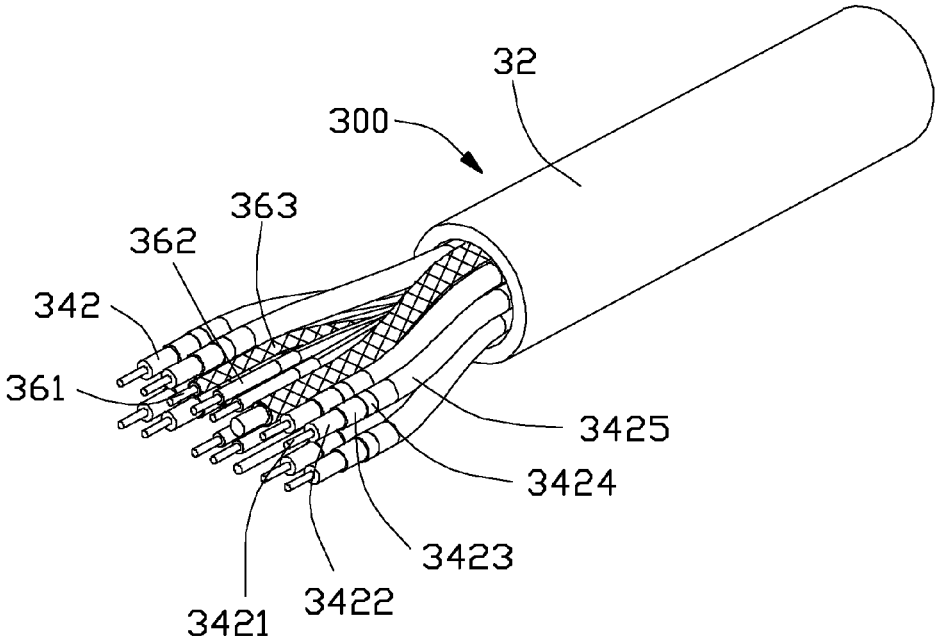
FIG. 8 is a perspective view of a cable of the cable connector assembly shown in FIG. 6.
Figure 11:
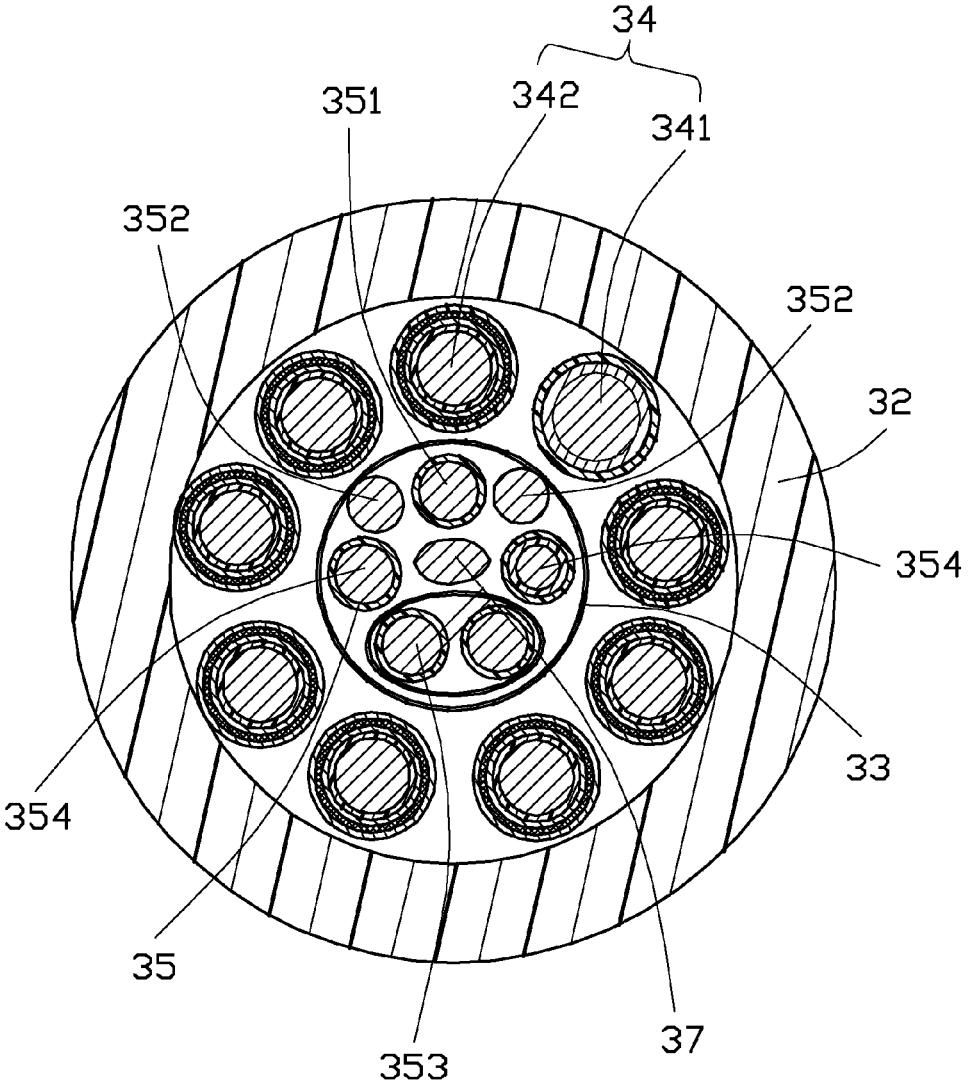
FIG. 11 is a cross section view of the cable connector assembly taken along line 11-11 in FIG. 1.

Referring to FIGS. 6-8, in conjunction with FIG. 11, the cable 300 comprises a plurality of core wires 31, an outer jacket 32 enclosing on the core wires 31, and a shielding layer 33 enclosing on inner core wires 31. The core wires 31 include a plurality of first/inner wires 34 located between the shielding layer 33 and the outer jacket 32, and a plurality of second/outer wires 35 enclosed in the shielding layer 33. Each of the first wires 34 has a larger diameter than that of the second wires 35. The second wires 35 are located in the middle of the cable 300, and the first wires 34 are evenly distributed on the outside of the shielding layer 33 so the cable 300 can have a smaller diameter with a better bending resistance. When the cable 300 is bent, one surface of the cable 300 is pressed while the opposite surface is stretched. The second wires 35 with smaller diameters can bear smaller pulling force and pressing force than the first wires 34 with larger diameters. The second wires 35 with smaller diameters are disposed in the middle of the cable 300 to enhance flexural capacity of the cable 300.

The first wires 34 comprise a power wire 341 for power transmission and a plurality of coaxial wires 342 for high speed signal transmission. The second wires 35 comprise a detective wire or so-called configuration channel wire 351 for detection signal transmission, a pair of grounding wires 352, a twisted/differential pair wire 353 for USB 2.0 signal transmission, and a spare wire 354 for transmitting the relevant signal according to customer's needs. For example, the spare wire 354 can be served as an audio wire for audio signal transmission. A filler 37 is arranged in the middle of the shielding layer 33 and mixed with the second wires 35 for filling spare room of the cable 300, thus the cable 300 can keep a circular configuration which is not easy to deform, thus the core wires 31 are not easy to shift. The power wire 341, the detective wire 351, the grounding wires 352, and the spare wire 354 are single wires 36. The first wires 34 are evenly arranged between the outer jacket 32 and the shielding layer 33, and the shielding layer 33 can prevent cross-talk between the power wire 341 and the second wires 35. The pair of grounding wires 352 are separated from each other by the detective wire 351.

The cable 300 can have two spare wires 354, and each spare wire 354 is located on one side of the neighboring grounding wire 352 away from the detective wire 351. Each grounding wire 352 is located between the detective wire 351 and the neighboring spare wire 354 to separate the detective wire 351 and the neighboring spare wire 354, so the cross-talk between the detective wire 351 and the spare wires 354 can be reduced. The twisted pair wire 353 has an insulative layer (not labeled) thereon, and the twisted pair wire 353 is defined opposite to the detective wire 351 along a radial direction with a filler 37 therebetween, to prevent the cross-talk between the twisted pair wire 353 and the detective wire 351. The shielding layer 33 has an aluminum foil inner surface, and the grounding wires 352 are connected with the inner surface of the shielding layer 33, to reduce pressure drop of the grounding wires 352 at the most extent. And a single traditional grounding wire is replaced by the two grounding wires 352, thus the diameter of the cable 300 can be decreased.

Some of the coaxial wires 342 and single wires 36 adjacent to and arranged in a row with the coaxial wires 342 are disposed on at least one surface of the PCB 2. Each coaxial wire 342 has a first inner conductor 3421, an inner insulative layer 3422 enclosing the first inner conductor 3421, a metal layer 3423 enclosing on the inner insulative layer 3422, a metal braided layer 3424 enclosing the metal layer 3423 and soldered to the corresponding third conductive pads 221, and an outer insulative layer 3425 enclosing the metal braided layer 3424. Except the grounding wires 352, each single wire 36 defines a second conductor 361 and a first insulative layer 362 enclosing the second conductor 361. And certain single wire 36 neighboring to the coaxial wires 342 further defines a second insulative layer 363 enclosing the first insulative layer 362. Each grounding wire 352 only has a second conductor 361. In a preferred embodiment, some coaxial wires 342 are disposed neighboring to a grounding wire 341 and a spare wire 354 on the upper surface 24 of the PCB 2, and other coaxial wires 342 are disposed neighboring to another grounding wire 341 on the lower surface 25. So the power wire 341 and the spare wire 354 each have a second insulative layer 363. In other embodiments, the single wire 36 neighboring to the coaxial wire 342 also can have a second insulative layer 363 according to application needs. The second insulative layer 363 can protect the first insulative layer 362 during soldering the metal braided layer 3424.

The first insulative layer 362 enclosed in the second insulative layer 363 is made of PTFE (Polytetrafluoroethylene). The heat resistance of the PTFE is strong so it is difficult to result short circuit when soldering the metal braided layer 3424 to the third conductive pads 221. The second insulative layer 363 is made of PET (Polyethylene terephthalate), a good adhesive performance of the second insulative layer 363 prevents the cable 300 from moving after using the glue to fix the cable with the retaining member 4. The first insulative layer 362 of each single wire 36 also can be made of PET or other material having good adhesive performance. The single wires 36 are arranged on an inside area of the PCB 2 with the coaxial wires 342 on both sides of the single wires 36. In other embodiment, the numbers of the coaxial wires 342 and the single wires 36 are defined according to application needs.

In this embodiment, the retaining member 4 comprises an upper half 41 holding some coaxial wires 342 and some single wires 36 on the upper surface 24 and a lower half 42 mounted to the upper half 41 holding the rest coaxial wires 342 and single wires 36 on the lower surface 25. The retaining member 4 also can be disposed in one piece in other embodiments. Each upper half 41 and lower half 42 comprises a front wall 43 proximal to the PCB 2, an opposite rear wall 44, and an upper wall 45 and a lower wall 46 connecting the front wall 43 and the rear wall 44. The retaining member 4 comprises a plurality of first positioning holes 47 and a plurality of second positioning holes 48 passing through the front wall 43 and the rear wall 44. The first positioning holes 47 are used for locating the coaxial wires 342, and the second positioning holes 48 are used for positioning the single wires 36.

The retaining member 4 comprises a notch 49 passing through the front wall 43 and the upper wall 45 and communicated with the second positioning holes 48. When cutting the coaxial wires 342, the single wires 36 can be bent into the notch 49 to avoid being hurting. Both the upper half 41 and the lower half 42 comprise the notch 49, the first and second positioning holes 47, 48. The single wires 36 are extending through the second positioning holes 48 and then located on the lower wall 46 to increase whole strength thereof, and convenient for welding the single wires 36 to the PCB 2. A plurality of limiting slots 461 are formed on the bottom wall 46 of the notch 49 for limiting the single wires 36 to move in the transverse direction. The front end of the retaining member 4 comprises a holding slot 490 for holding the PCB 2.

Figure 3:
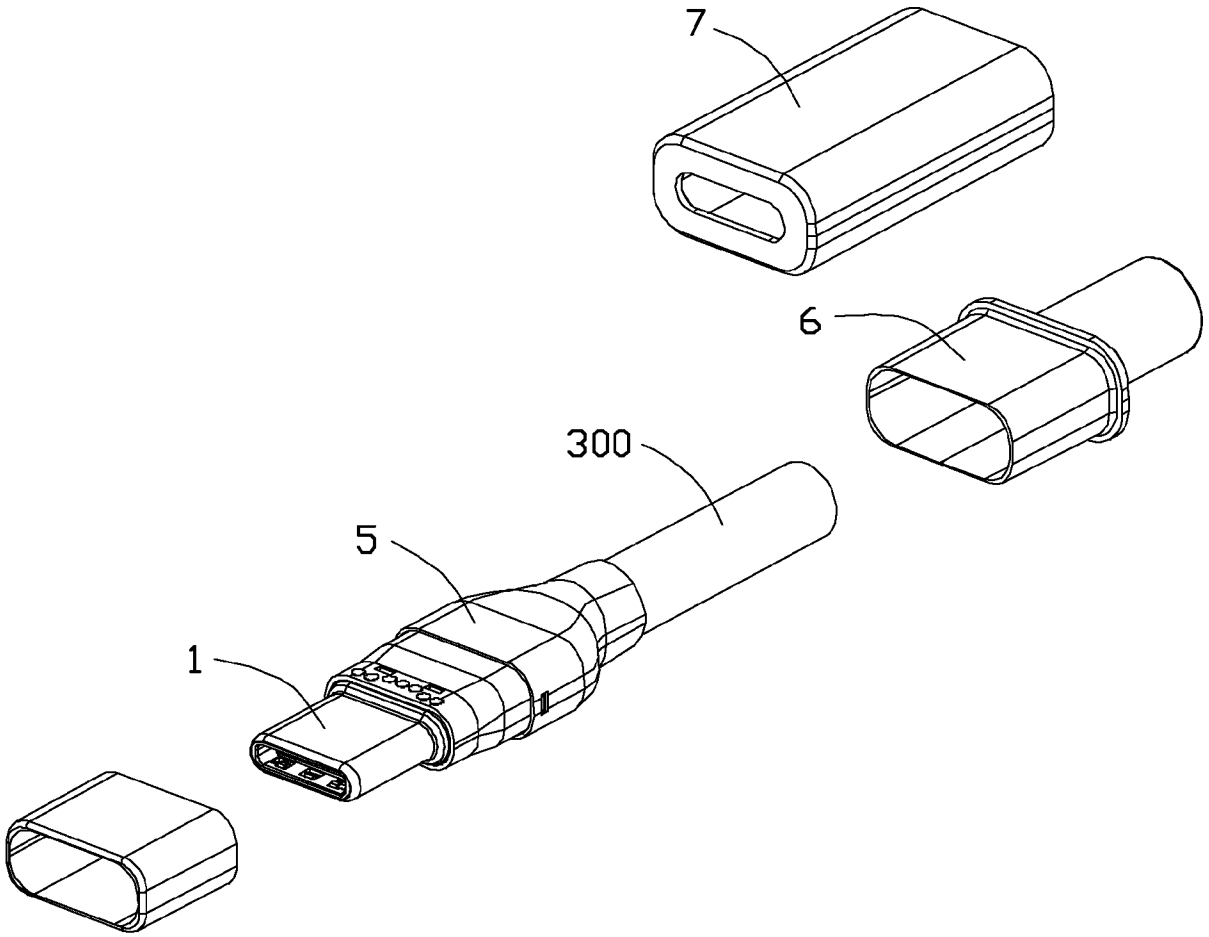
FIGS. 3 is a further exploded view of the cable connector assembly shown in FIG. 2.
Figure 4:
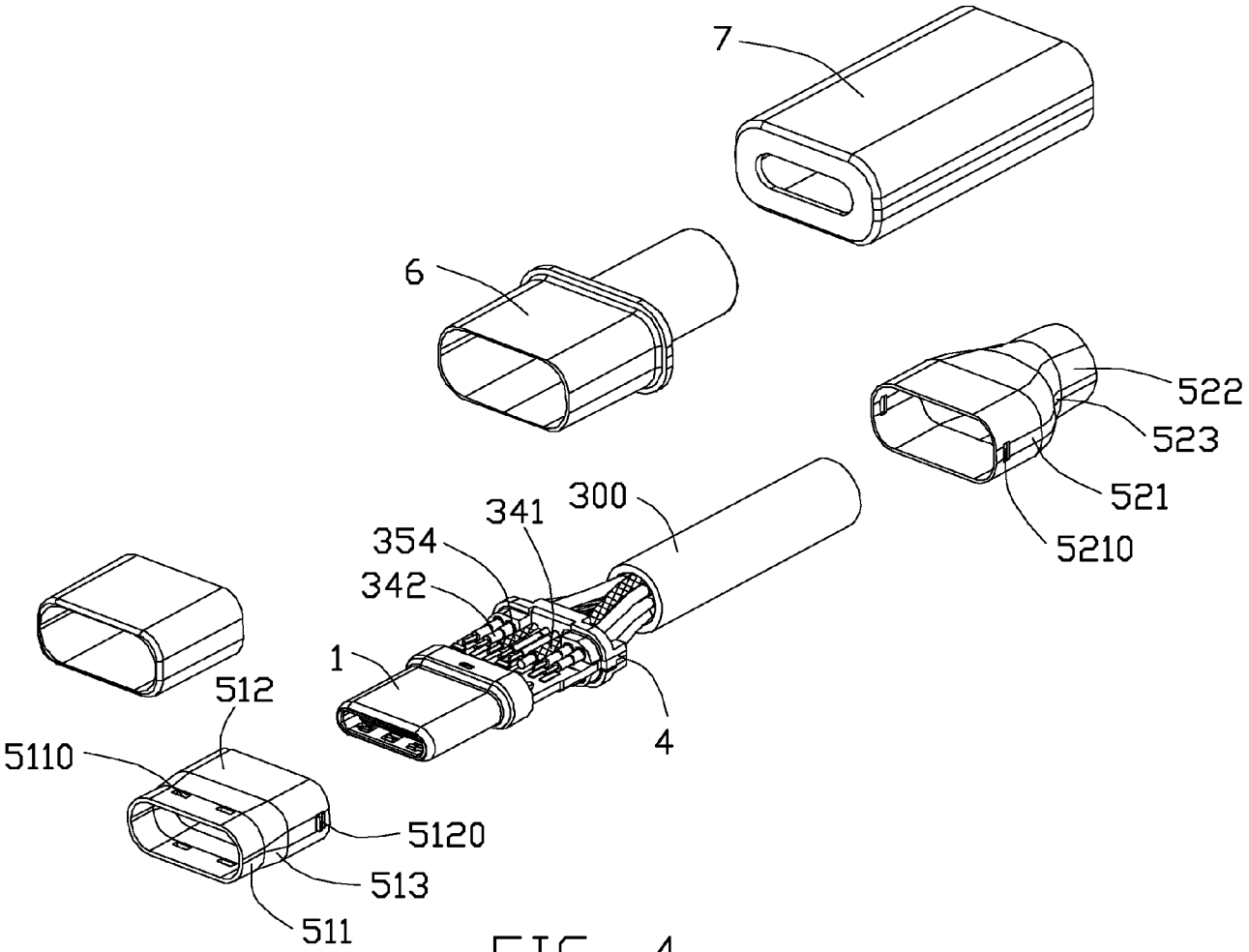
FIG. 4 is a further exploded view of the cable connector assembly shown in FIG. 3.
Figure 5:
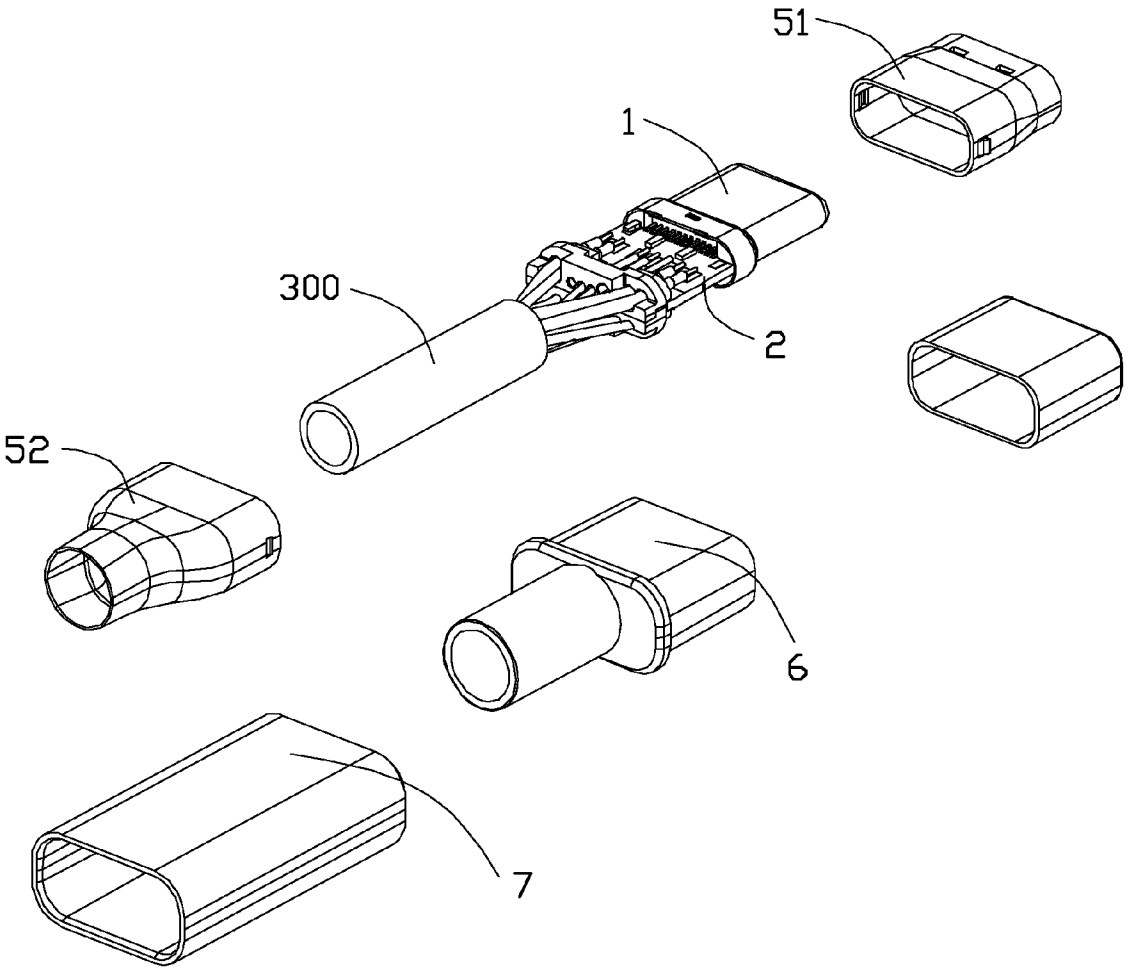
FIG. 5 is a view similar to FIG. 4, but viewed from another aspect.

Referring to FIGS. 3 and 4, the inner insulator 5 comprises a first member 51 and a second member 52. The first member 51 has a closed circumference that has a good seal performance, a good anti-EMI performance, etc. The closed circumference of the first member 51 could be manufactured by drawing a metal piece, bending and forming a metal piece, die casting, etc. The first member 51 comprises a second front end 511 telescoped with a rear end of the mating member 1, a second rear end 512 opposite to the second front end 511, and a second transition portion 513 between the second front and rear ends. The diametrical dimension of the second front end 511 is smaller than the diametrical dimension of the second rear end 512. The second front end 511 defines a pair of latch holes 5110 latched with the latch tabs 1520 of the metal shell 15, when the second member 51 is telescoped on an outer side of the first rear end 152 of the metal shell 15. A pair of projections 5120 are disposed on two sides of the second rear end 512. The second front end 511 of the first member 51 is interference fit with the first rear end 152 of the metal shell 15. The second front end 511 of first member 51 and the first rear end 152 of the metal shell 15 are further connected by laser welding in some spots or full circumference to have a good strength. The second rear end 512 is telescoped on an outer side of the retaining member 4.

The second member 52 has a closed circumference that has a good seal performance, a good anti-EMI performance, etc. The closed circumference of the second member 52 could be manufactured by drawing a metal piece, bending and forming a metal piece, die casting, etc. The second member 52 comprises a main portion 521 telescoped with the second rear end 512 of the first member 51, a ring portion 522 telescoped and crimped with the cable 3, and a third transition portion 523 between the main portion 521 and the ring portion 522. The diametrical dimension of the main portion 521 is larger than the diametrical dimension of the ring portion 522. The main portion 521 of second member 52 and the second rear end 512 of the first member 51 are further connected by spot laser welding to have a good strength.

The second member 52 is firstly covering on the cable 300, the coaxial wires 342 and the single wires 36 are soldering with the second conductive pads 220, the main portion 521 is sleeved on the retaining member 4 to improve assembly precision of the second member 52. A pair of locking holes 5210 are defined on both sides of the main portion 521, the main portion 521 is moved forwardly and across the retaining member 4 to package on the second rear end 512, and the projections 5120 are latching with the corresponding locking holes 5210. The main portion 521 with a larger dimension is interferentially enclosing on the second rear end 512 to avoid interference with the cable 300. The main portion 521 and the second rear end 512 are further connected by laser welding in some spots or full circumference to have a good strength and conjunction. The ring portion 522 is enclosing and crimped on the cable 300.

When manufacturing the cable connector assembly 200, the PCB 2 is inserted into a rear end of the sub-connector 1, the extending arms 134 of the latch member 13 are soldered to the metal pad 230 of the PCB 2. The coaxial wires 342 are passing through the first positioning holes 47 and the single wires 36 are passing through the second positioning holes 48. Then the cable 300 is secured on the retaining member 4 via glue. Then the single wires 36 are bending into the notches 49 to be out of way, core wires are processing by laser cutting or other manner. The outer insulative layer 3425 of each coaxial wire 342 is cut to expose the metal braided layer 3424, and then front part of the metal braided layer 3424 is cut to expose the metal layer 3423, and the metal layer 3423 is cut to expose the inner insulative layer 3422.

Then restoring the single wires 32 to its original state before bending, the coaxial wires 342 and the single wires 36 limiting by the upper half 41 are cut, to expose the first inner conductor 3421 by removing the inner insulative layer 3422, and expose the second conductor 361 by removing the first insulative layer 362 and the second insulative layer 363. Then the coaxial wires 342 and the single wires 36 limiting by the lower half 41 are cut, to expose the first inner conductor 3421 and the second conductor 361.

Then the cable 300 is soldering to the PCB 2, and the first inner conductors 3421 are soldered to the corresponding second conductive pads 220 on the upper surface 24 of the PCB 2, the metal braided layers 3424 are welding to the third conductive pads 221. The first insulative layer 362 of the single 36 neighboring to the coaxial wires 342 is made of teflon material to prevent short-circuit. The second conductors 361 are soldered to the corresponding second conductive pads 220 on the lower surface 25 of the PCB 2.

The inner insulator 5 is enclosing on at least part of the sub-connector 1 and the cable 300. The strain relief member 6 is molded onto at least part of the inner insulator 5 and the cable 300. The cover 7 is mounted out of the inner insulator 5 and the strain relief member 6 along the front-to-rear direction and then glue is used to fix the cover 7. One feature of the invention is to have the filler 37 essentially located at the center of the shielding layer 33. To obtain this arrangement, the twisted pair wire 353 forms a capsular or elliptical contour by the outer insulative layer with a short axis and the long axis thereof wherein the short axis faces the filler 37 opposite to the detective wire 351 with the filler 3 37 therebetween diametrically. Because the filler 37 is essentially located at the center of the shielding layer 33, the whole cable assembly may endure a relatively larger bending movement in different radial directions.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector comprising:

an electrical connector; and a cable connected with the electrical connector, and comprising a plurality of core wires including a plurality of first wires and a plurality of second wires, an outer jacket enclosing on the core wires, and a shielding layer enclosing on the second wires; wherein the first wires comprises a power wire for power transmission and a plurality of coaxial wires for high speed signal transmission, the second wires comprises a detective wire for detection signal transmission, a pair of grounding wires, a twisted pair wire for USB 2.0 signal transmission and a spare wire, each of the first wires has a larger diameter than that of the second wires, the first wires are located between the shielding layer and the outer jacket, the second wires are enclosed in the shielding layer.

2. The cable connector assembly as recited in claim 1, wherein the pair of grounding wires are separated from each other by the detective wire.

3. The cable connector assembly as recited in claim 2, wherein the cable can have two spare wires, and each spare wire is located on one side of a neighboring grounding wire away from the detective wire.

4. The cable connector assembly as recited in claim 3, wherein the shielding layer has an aluminum foil inner surface, and the grounding wires are connected with the inner surface of the shielding layer.

5. The cable connector assembly as recited in claim 4, wherein the twisted pair wire is disposed opposite to the detective wire along a radial direction.

6. The cable connector assembly as recited in claim 5, wherein a filler is arranged in the middle of the shielding layer and mixed with the second wires for filling a spare room of the cable.

7. The cable connector assembly as recited in claim 6, wherein each grounding wire is located between the detective wire and the neighboring spare wire to separate the detective wire and the neighboring spare wire.

8. The cable connector assembly as recited in claim 5, wherein the twisted pair wire has an insulative layer thereon.

9. The cable connector assembly as recited in claim 1, wherein each coaxial wire has a first inner conductor, an inner insulative layer enclosing the first inner conductor, a metal layer enclosing on the inner insulative layer, a metal braided layer enclosing the metal layer, and an outer insulative layer enclosing the metal braided layer.

10. The cable connector assembly as recited in claim 9, wherein the electrical connector comprises a printed circuit board having a conductive pad, and the metal braided layer is soldered to the conductive pad.

11. The cable connector assembly as recited in claim 1, wherein the electrical connector comprises a sub-connector, a printed circuit board electrically connected with the sub-connector, a retaining member limiting the cable, an inner insulator enclosing on the sub-connector and the cable, a strain relief member formed on the inner insulator and the cable, and an outermost cover.

12. The cable connector assembly as recited in claim 1, wherein in a cross-sectional view, the twisted pair wire includes an insulative layer forming an elliptical or capsular contour defined by a short axis and a long axis thereof, and the short axis faces to the detective wire with the filler therebetween diametrically, wherein the filler is essentially located at a center of the shielding layer.

13. A cable comprising:

an outer jacket;

a plurality of core wires enclosed in the outer jacket and including a plurality of first wires and a plurality of second wires; and a shielding layer enclosing the second wires; wherein the first wires comprise a power wire for power transmission and a plurality of coaxial wires for high speed signal transmission, the second wires comprise a detective wire for detection signal transmission, a pair of grounding wires, a twisted pair wire for USB 2.0 signal transmission, and a spare wire, each of the first wires has a larger diameter than that of each of the second wires, the first wires are located between the shielding layer and the outer jacket, and the second wires are enclosed in the shielding layer.

14. The cable as recited in claim 13, wherein the second wires are located in the middle of the cable, and the first wires are evenly distributed on the outside of the shielding layer.

15. The cable as recited in claim 14, wherein the pair of grounding wires are separated from each other by the detective wire, there are two spare wires, and each spare wire is located on one side of a neighboring grounding wire distal from the detective wire.

16. The cable recited in claim 13, wherein in a cross-sectional view, the twisted pair wire includes an insulative layer forming an elliptical or capsular contour defined by a short axis and a long axis thereof, and the short axis faces to the detective wire with the filler therebetween diametrically, wherein the filler is essentially located at a center of the shielding layer.

17. A cable connector comprising:

an insulative housing defining a mating cavity;

a plurality of contacts disposed in the housing and arranged in two rows under a diagonally symmetrical manner between said two rows;

a printed circuit board located behind the housing, the contacts mechanically and electrically connected to a front region of the printed circuit board;

a cable located behind the printed circuit board and mechanically and electrically connected to a rear region of the printed circuit board, said cable including:

a plurality of inner wires and a plurality of outer wires surrounding said inner wires with a metallic shielding layer therebetween radially, the shielding layer circumferentially surrounding said inner wires, said inner wires including a filler essentially located at the center, a twisted differential pair for USB 2.0 transmission, a pair of spare wires, a pair of grounding wires and a detective wire commonly surrounding said filler;

wherein in a cross-sectional view, the pair of spare wires are opposite to each other diametrically;

the twisted pair wire has an insulative layer defining an elliptical or capsular contour with a short axis and a long axis thereof, the short axis being opposite to the detective wire with the filler therebetween diametrically;

each of said grounding wires is located between the detective wire and the corresponding spare wire along a circumferential path; and the pair of spare wires are symmetrically opposite to each other with regard to a radius defined between the filler and the detective wire, and the pair of grounding wires are symmetrically opposite to each other with regard to said radius.

* * * * *